US012582890B2

(12) United States Patent
Gasnier

(10) Patent No.: US 12,582,890 B2
(45) Date of Patent: Mar. 24, 2026

(54) GARMENTS AND METHOD FOR PLAYING SPORT

(71) Applicant: Mark Gasnier, Avalon (AU)

(72) Inventor: Mark Gasnier, Avalon (AU)

(73) Assignee: Mark Gasnier, New South Wales (AU)

( * ) Notice: Subject to any disclaimer, the term of this patent is extended or adjusted under 35 U.S.C. 154(b) by 57 days.

(21) Appl. No.: 18/558,645

(22) PCT Filed: May 2, 2022

(86) PCT No.: PCT/AU2022/050407

§ 371 (c)(1),
(2) Date: Nov. 2, 2023

(87) PCT Pub. No.: WO2022/232869

PCT Pub. Date: Nov. 10, 2022

(65) Prior Publication Data

US 2024/0238663 A1 Jul. 18, 2024

(30) Foreign Application Priority Data

May 3, 2021 (AU) ..... 2021901305
Jun. 9, 2021 (AU) ..... 2021203816

(51) Int. Cl.
*A63B 71/02* (2006.01)
*A41B 1/08* (2006.01)
*A41D 1/089* (2018.01)

(52) U.S. Cl.
CPC ..... *A63B 71/02* (2013.01); *A41B 1/08* (2013.01); *A41D 1/089* (2018.01); *A41D 2600/10* (2013.01)

(58) Field of Classification Search
CPC .. A41D 1/089; A41D 13/002; A41D 13/0015; A41D 2400/70; A41D 2600/10; A63B 71/00
See application file for complete search history.

(56) References Cited

U.S. PATENT DOCUMENTS 3,760,461 A * 9/1973 Wright ..... A41D 13/0015 D6/601
2002/0088046 A1* 7/2002 Fidler ..... A41B 13/00 2/80

(Continued)

FOREIGN PATENT DOCUMENTS

AU 662907 * 1/1993 ..... A63B 71/04
AU 662907 B2 9/1995
WO 2015024049 A1 2/2015

OTHER PUBLICATIONS

Australian Patent Office International-Type Search Report, AU Application No. 2021901305, mailed May 3, 2023. 11 pages.

(Continued)

*Primary Examiner* — Patrick J. Lynch
*Assistant Examiner* — Brianna T. Duckworth
(74) *Attorney, Agent, or Firm* — Bookoff McAndrews PLLC

(57) ABSTRACT

Garment (10) for playing sport, typically being a ball sport, such as rugby football. The garment (10) includes a pair of side tags (12) releasably attachable to a pair of attachment portions (18) arranged to be spaced from each other at opposed sides of the garment (10), a rear tag (14) releasably attachable to a further attachment portion (18) arranged at a rear of the garment (10), and at least one strap (16) connected between the garment (10) and at least one of the tags (12, 14) to allow the, or each, connected tag (12, 14) to be detached from the at least one associated attachment portion (18) and be suspended from the garment (10).

10 Claims, 7 Drawing Sheets

(56) References Cited

U.S. PATENT DOCUMENTS

| | | | | |
|---|---|---|---|---|
| 2003/0182714 | A1* | 10/2003 | Mariland | A41D 13/0015 2/247 |
| 2008/0139345 | A1* | 6/2008 | Baun | A63B 67/00 473/502 |
| 2009/0098957 | A1* | 4/2009 | Hitchcock | A63B 67/00 2/243.1 |
| 2018/0289138 | A1* | 10/2018 | Lewis | A63B 71/0605 |

OTHER PUBLICATIONS

International Search Report and Written Opinion, PCT/AU2022/050407, mailed Jun. 27, 2022. 12 pages.

* cited by examiner

GARMENTS AND METHOD FOR PLAYING SPORT

CROSS-REFERENCE TO RELATED APPLICATION(S)

This is a National Stage Application under 35 U.S.C. § 371 of International Application No. PCT/AU2022/050407, filed May 2, 2022, which claims priority to Australian Patent Application No. 2021203816, filed on Jun. 9, 2021, and Australian Patent Application No. 2021901305, filed on May 3, 2021, the entireties of which are incorporated herein by reference.

TECHNICAL FIELD

The present disclosure relates, generally, to garments which are worn for playing a sport and, particularly, to garments which are worn to assist playing non-contact ball sports.

BACKGROUND

Ball sports often require physically tackling a player to allow one team to steal possession of a ball from an opponent team. For some sports, such as rugby football, American football ("grid iron"), Australian football, and Gaelic football, tackling is a common source of injury. This is particularly problematic for youth and older players, often meaning that younger players are deterred from participating in the sport, or player participation decreases with age.

One approach to address this issue is to modify the sport to be non-contact. A popular version of non-contact rugby, known as "touch football", involves lightly touching a player or the ball to indicate a tackle has been made. A variation of this version of the sport is known as "tag rugby" (also known as "flag rugby") where players wear a belt carrying a pair of tags releasably arranged at, and suspended from, the player's hips. A player is tackled when another player grasps and removes a tag from the belt.

Any discussion of documents, acts, materials, devices, articles or the like which has been included in the present specification is not to be taken as an admission that any or all of these matters were common general knowledge in the field relevant to the present disclosure as it existed before the priority date of each of the appended claims.

SUMMARY

In one aspect, there is provided a garment for playing sport, the garment including a body portion configured to be worn on the user's body, a pair of attachment portions arranged to be spaced from each other at opposed sides of the body portion, and a pair of elongate straps. Each strap defines a fixed end secured to the body portion, an opposed free end, and an intermediate portion extending between the ends. The free end of each strap is configured to be releasably connectable to one of the pair of attachment portions. The free end of the strap is configured to be manually separable from the associated attachment portion to allow the free end to be suspended from the body portion. Connecting the free end of any strap to its associated attachment portion may cause the intermediate portion of the strap to hang operatively below the attachment portion.

The garment may include a further attachment portion arranged at a rear of the body portion, and a tag configured to releasably attach to the further attachment portion, the tag shaped to be manually graspable to allow separating the tag from the further attachment portion such that the tag is disconnected from the body portion.

The garment may include a further attachment portion arranged at a rear of the body portion, and a further elongate strap defining a fixed end secured to the body portion, an opposed free end, and an intermediate portion extending between the ends, the free end configured to be releasably connectable to the further attachment portion so that the free end is manually separable from the further attachment portion to allow the free end to be suspended from the body portion.

The free end of each strap may be associated with a tag configured to releasably attach to one of the attachment portions, each tag being shaped to be manually graspable to allow separating the tag from the attachment portion such that the tag is suspended from the garment by the strap.

Each tag may include an elongate strip. Each tag may be configured such that attaching the tag to one of the attachment portions arranges an end of the strip to be spaced, typically being suspended, from the attachment portion to allow the end portion to be grasped.

Each strap may be configured to be at least partially stretchable to allow elongating the strap when the free end is manually separated from the attachment portion.

The free end of each strap may be configured to be separable from the attachment portion when a first force is applied, and the fixed end of each strap may be releasably secured to the garment and configured to be separable from the garment when a second force is applied, the second force being greater than the first force.

The attachment portions may be positioned on the garment such that, when the garment is worn by a player, the further attachment portion is arranged adjacent the player's sacrum and the pair of attachment portions are arranged adjacent each of the player's hips.

Each attachment portion and free end of each strap may be associated with complementary hook and loop fasteners operable to releasably attach the tag to the garment.

Each of the pair of attachment portions may be configured as a triangular shaped patch. Additionally, the further attachment portion may be configured as a triangular shaped patch.

The body portion may be configured as one of: a shirt, jersey, a singlet, or a headband.

The body portion may be configured as one of: a pair of shorts, a pair of leggings, a pair of tights, a belt, and a pair of pants.

In another aspect, there is provided a garment for playing sport, the garment including a body portion configured to be worn on the user's body, a pair of side tags releasably attachable to a pair of attachment portions arranged to be spaced from each other at opposed sides of the body portion, a rear tag releasably attachable to a further attachment portion arranged at a rear of the body portion, and at least one strap connected between the body portion and at least one of the tags to allow the, or each, connected tag to be detached from the at least one associated attachment portion and be suspended, by the at least one strap, operatively below the attachment portion to allow the tag to swing freely.

In a further aspect, there is provided a garment for playing sport, the garment including a body portion configured to be worn on the user's body, a pair of attachment portions arranged to be spaced from each other at opposed sides of the body portion, and a pair of elongate straps, each strap defining a fixed end secured to the body portion, an opposed free end, and an intermediate portion extending between the ends, the free end configured to be releasably connectable to one of the attachment portions to allow the intermediate portion to hang operatively below the attachment portion, and the free end configured to be manually separable from the associated attachment portion to allow the free end to be suspended from the body portion.

According to another aspect, there is provided a method for playing a team sport where each player wears a garment according to any one of the preceding paragraphs configured such that the free end of each strap is connected to the associated attachment portion, the method including a first player of a first team manually separating one of the free ends from the associated attachment portion of the garment of a second player of the second team to cause the free end to be suspended from the body portion, where separating the free end from the attachment portion indicates a change of state of play of the game.

The method may include detaching one of the free ends from one of the pair of attachment portions to indicate a tackle and that play must cease.

Where the garment includes the further attachment portion and associated strap, the method may further include a third player of the second team manually separating the free end of the strap attached to the further attachment portion of the garment of the second player to indicate a further change of state of play.

The method may include separating the free end of the strap attached to the further attachment portion indicates play must continue.

The method may include separating the free end of the strap attached to the further attachment portion to indicate players of the second team must form a ruck.

The method may further involve, after separating the free end of the strap attached to the further attachment portion, the third player standing in a position to guard the ruck.

The method may further include the second player reconnecting the free end of each strap to the garment to allow the second player to continue playing.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

It will be appreciated embodiments may comprise steps, features and/or integers disclosed herein or indicated in the specification of this application individually or collectively, and any and all combinations of two or more of said steps or features.

BRIEF DESCRIPTION OF DRAWINGS

Embodiments will now be described by way of example only with reference to the accompany drawings in which.

DESCRIPTION OF EMBODIMENTS

Figure 1:
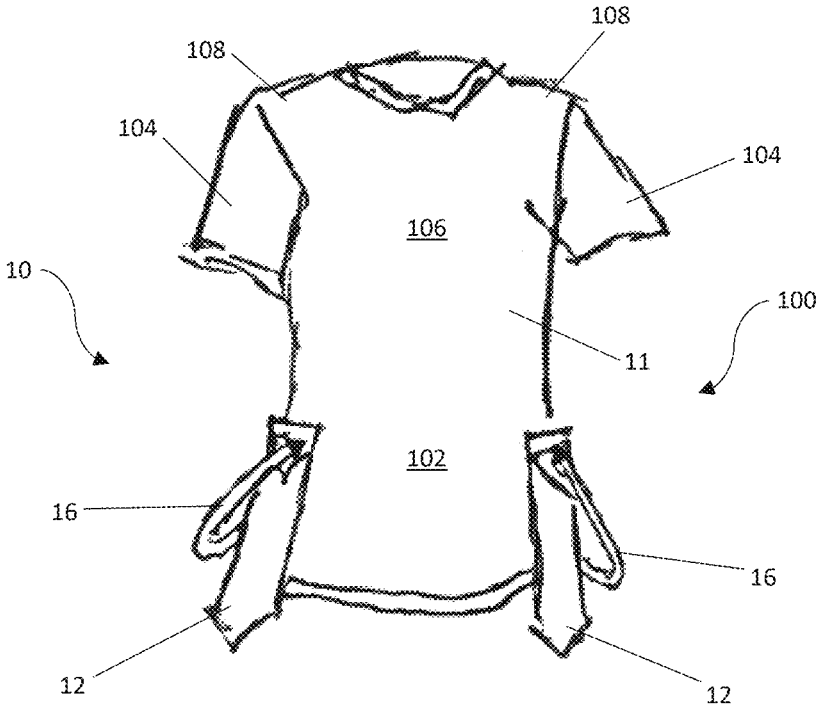
FIGS. 1 to 4 are front, rear and side views, respectively, of a first embodiment of a garment for playing sport, the first embodiment in a first configuration.
Figure 2:
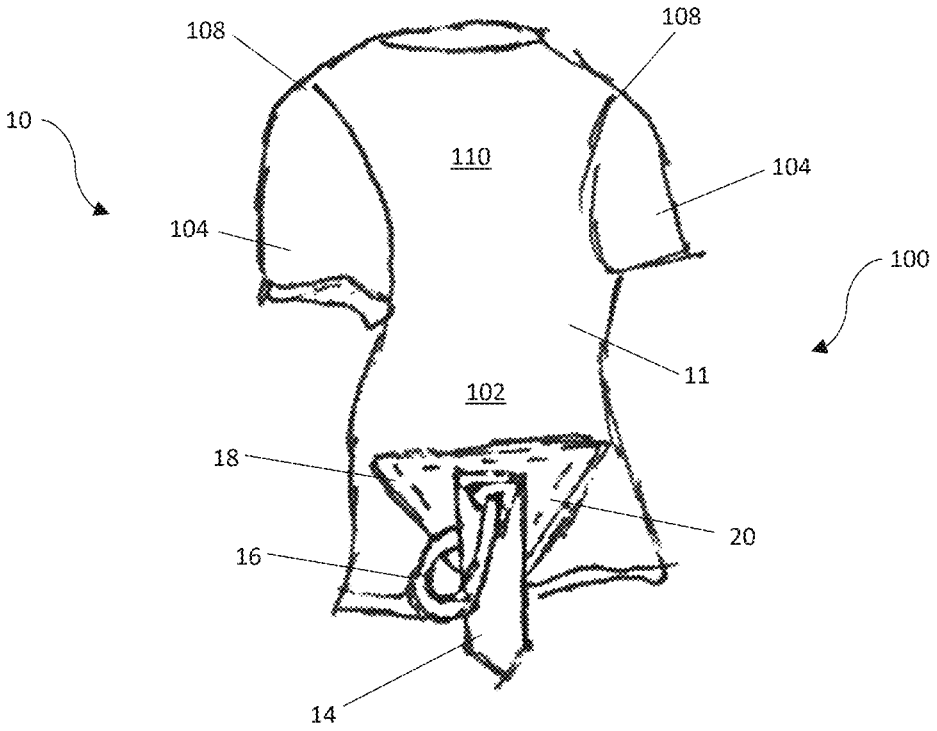
Figure 3:
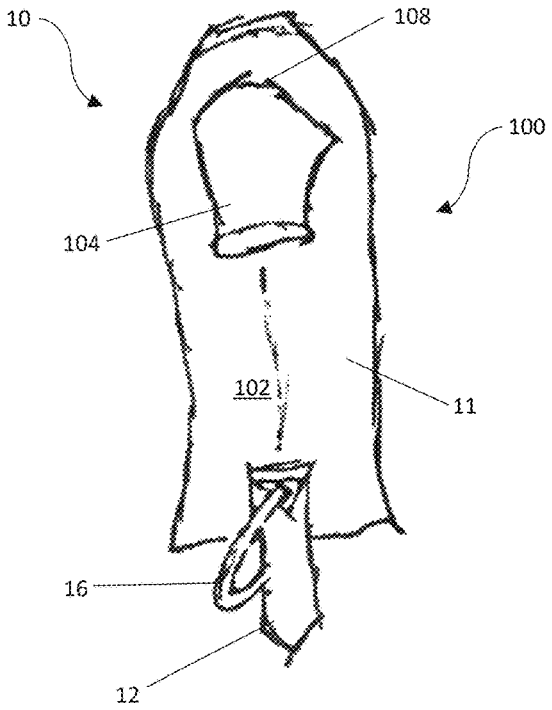
Figure 4:
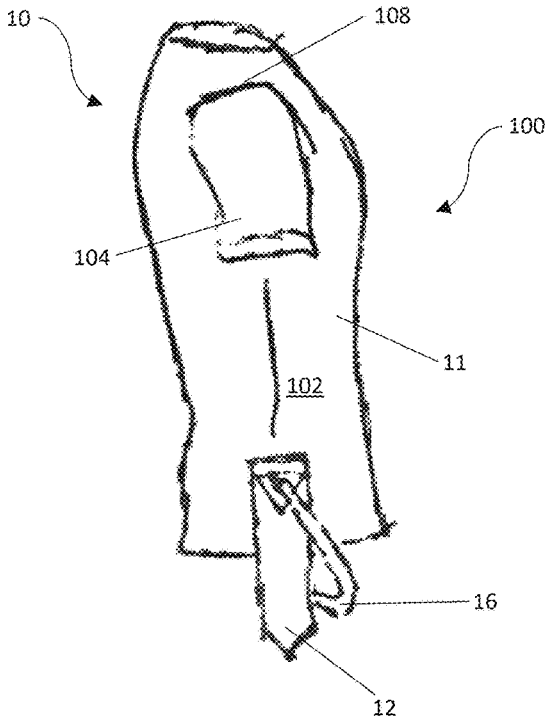
Figure 5:
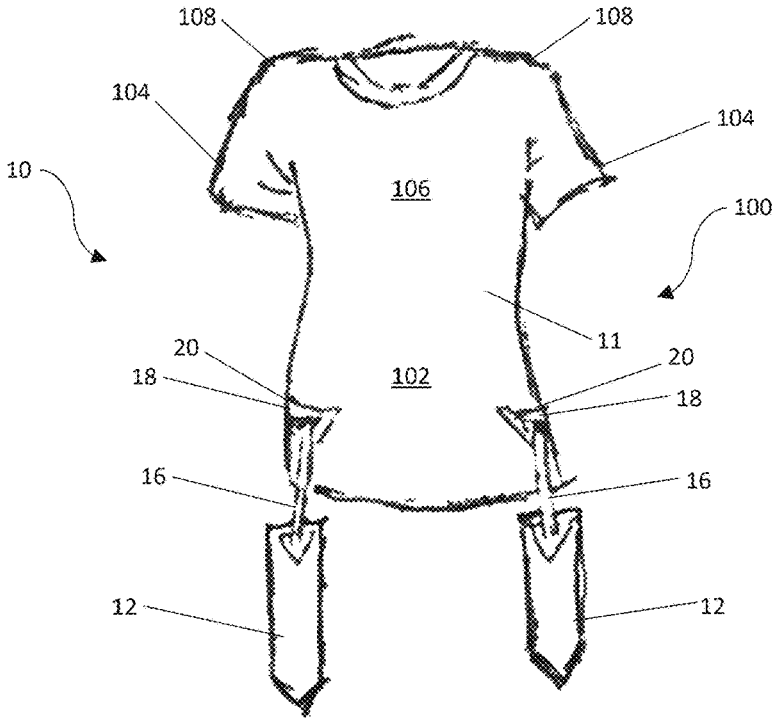
FIGS. 5 to 8 are front, rear and side views, respectively, of the first embodiment of the garment in a second configuration.
Figure 6:
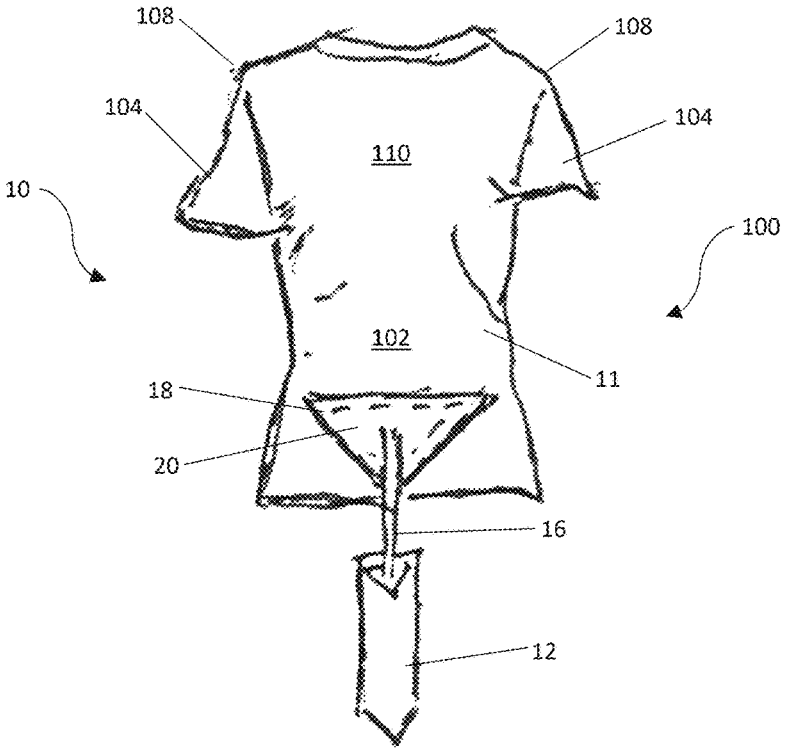
Figure 7:
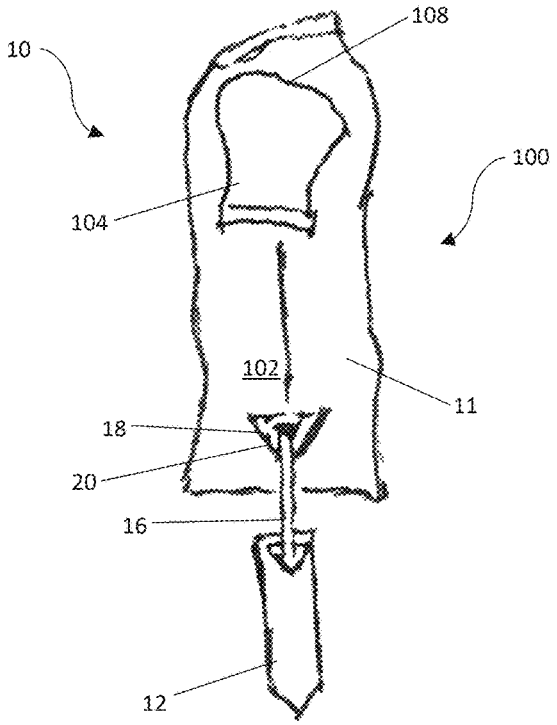
Figure 8:
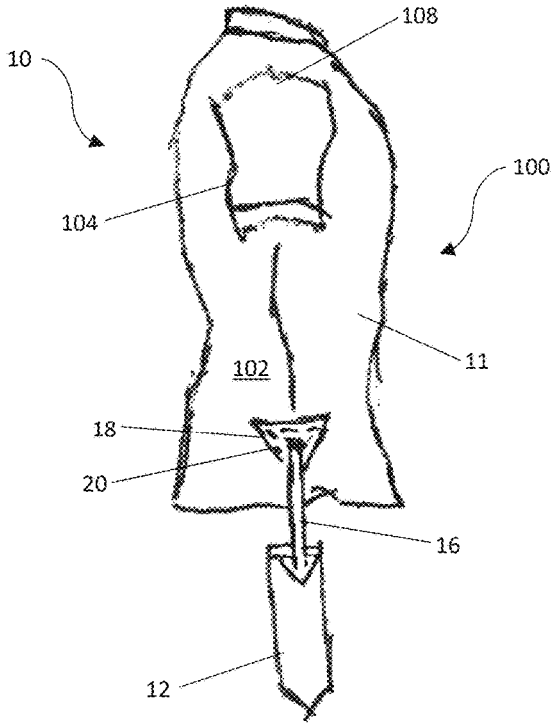

In the drawings, reference numeral 10 generally designates a garment 10 for playing sport, typically being a ball sport, such as rugby football. The garment 10 includes a body portion 11 configured to be worn on the user's body, and a pair of attachment portions 18 arranged to be spaced from each other at opposed sides of the body portion 11. Some embodiments also include a further attachment portion 18 arranged at a rear of the garment 10. The garment 10 further includes at least a pair of elongate straps 16. Each strap 16 defines a fixed end 17 secured to the body portion 11, an opposed free end 19, and an intermediate portion 21 extending between the ends 17, 19. The free end 19 is configured to be releasably connectable to one of the attachment portions 18 to allow the intermediate portion 21 to hang operatively below the attachment portion 18. Each free end 19 is configured to be manually separable from the associated attachment portion 18 to allow the free end 19 to be suspended from the body portion 11. Separating the free end 19 of the strap 16 from the associated attachment portion 18 so it is suspended from the garment 10 indicates a change in state of play of the sport, such as a tackle being made.

FIGS. 1 to 8 show a first embodiment of the garment 10, where the body portion 11 is in the form of a shirt or jersey 100. In other embodiments (not illustrated), the body portion 11 of the garment 10 is in the form of a sleeveless singlet or vest. FIGS. 1 to 4 show the shirt 100 in a first configuration with the free ends 19 of the three straps 16 connected to the three attachment portions 18 arranged about a torso covering portion 102 of the shirt 100. FIGS. 5 to 8 show the shirt 100 in a second configuration with all of the free ends 19 of the straps 16 separated from the attachment portions 18 to be suspended from the shirt 100. The second configuration is typically a result of the free ends 19 of the straps 16 being manually separated from the associated attachment portions 18 during play of the sport.

Figure 9:
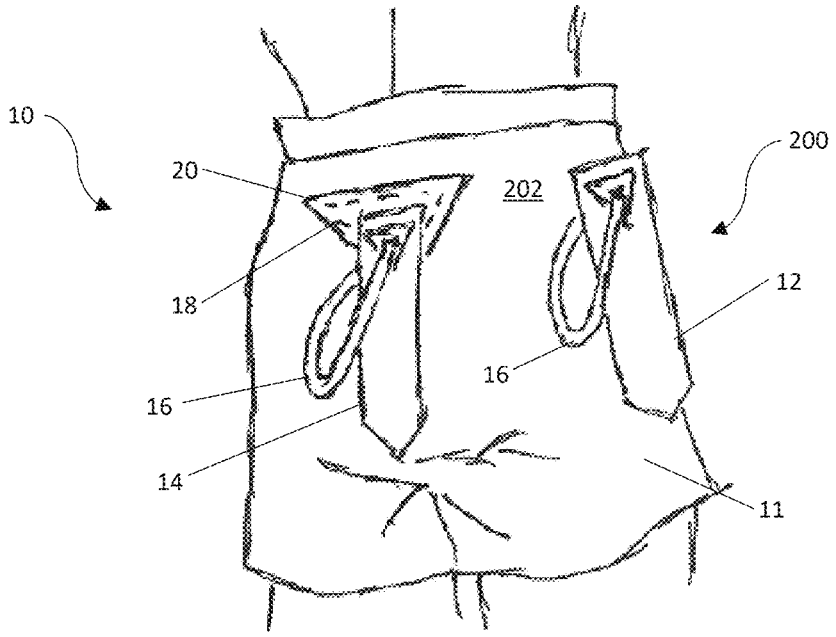
FIGS. 9 and 10 are rear perspective and rear views, respectively, of a second embodiment of a garment for playing sport, the second embodiment in a first configuration.
Figure 10:
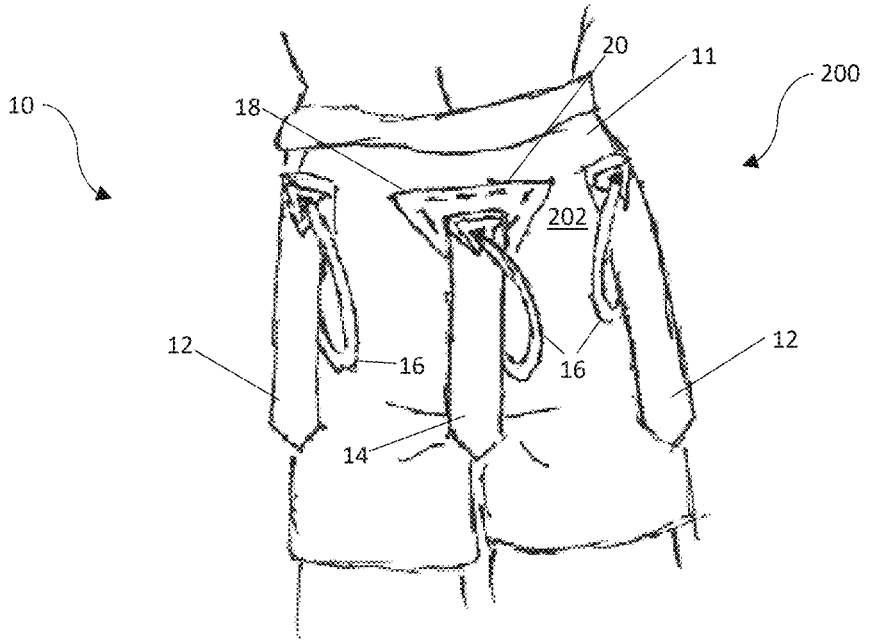
Figure 11:
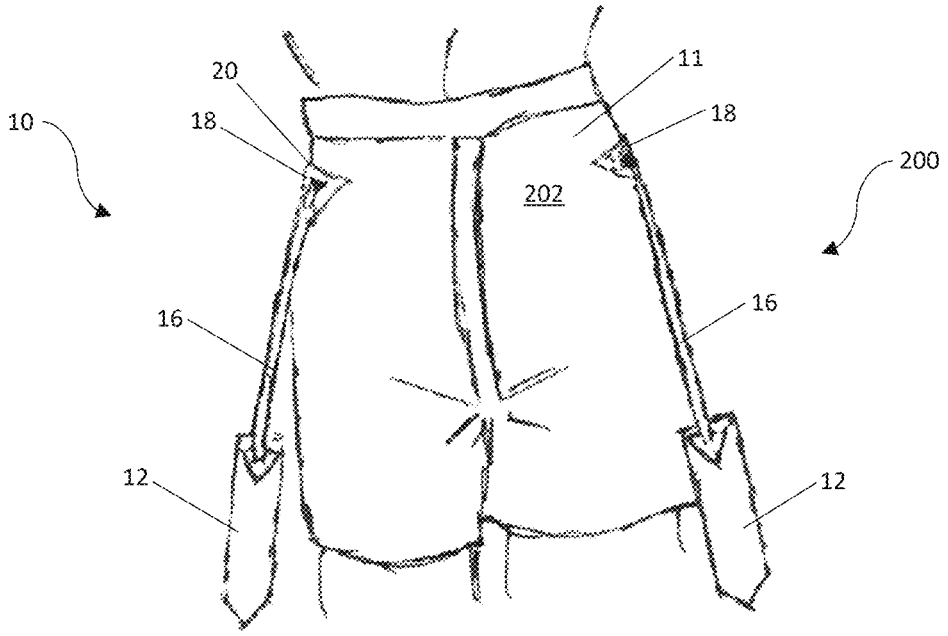
FIGS. 11 and 12 are front and rear perspective views, respectively, of the second embodiment of the garment in a second configuration.
Figure 12:
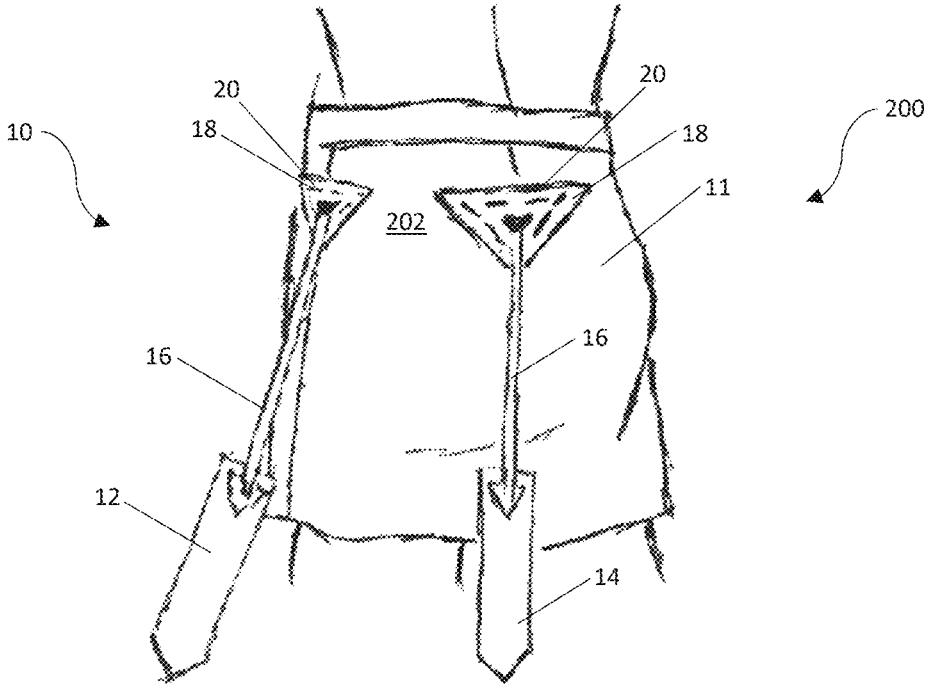

FIGS. 9 to 12 show a second embodiment of the garment 10, where the body portion 11 is in the form of a pair of shorts 200. In other embodiments (not illustrated), the body portion 11 of the garment 10 is in the form of leggings, tights, or pants. FIGS. 9 and 10 show the shorts 200 in a first configuration with all the free ends 19 of the three straps 16 connected to the three attachment portions 18 arranged about a waist region 202 of the shorts 200. FIGS. 11 and 12 show the shorts 200 in a second configuration with all of the free ends 19 of the straps 16 separated from the attachment portions 18 to be suspended from the shorts 200. The second configuration is typically a result of the free ends 19 of the straps 16 being manually separated from the associated attachment portions 18 during play of the sport.

Figure 13:
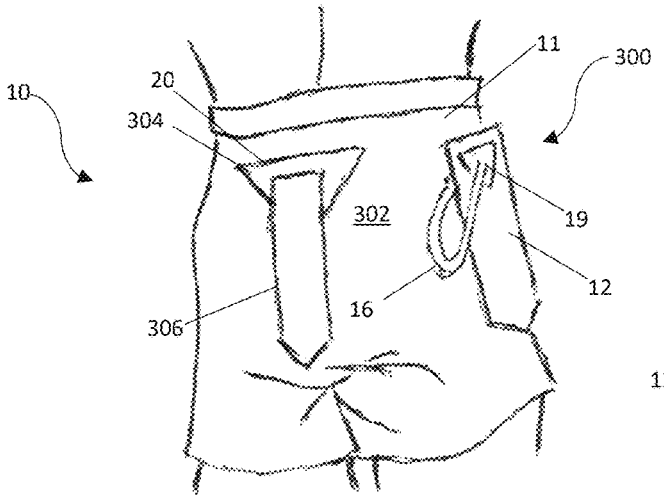
FIGS. 13 and 14 are rear perspective and rear views, respectively, of a third embodiment of the garment in a first configuration.
Figure 14:
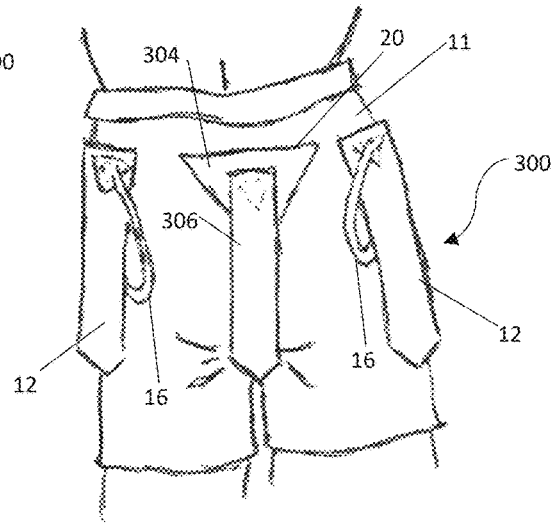
Figure 15:
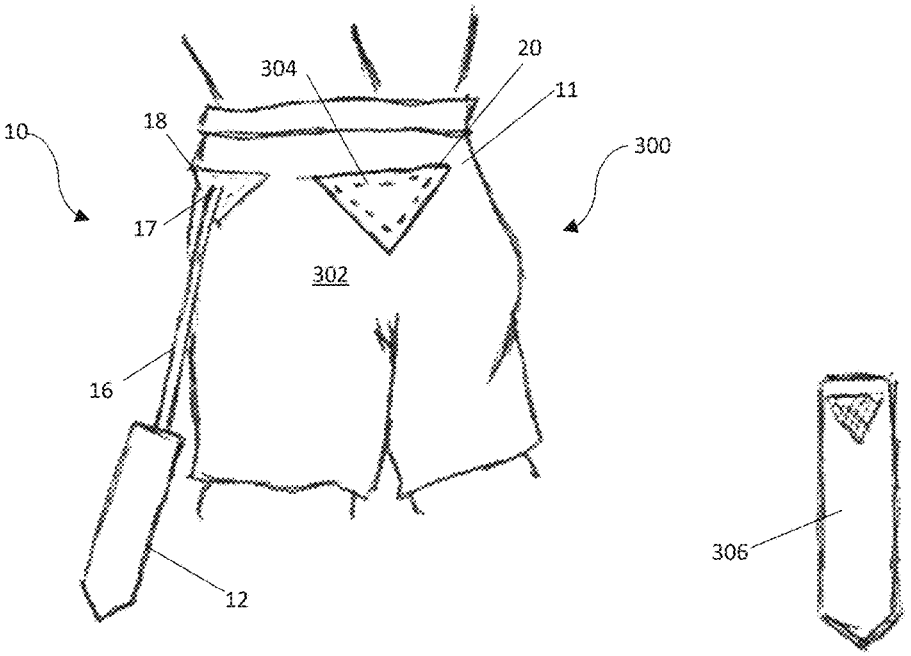
FIG. 15 is an alternative rear perspective view of the third embodiment of the garment in a second configuration.

FIGS. 13 to 15 show a third embodiment of the garment 10, where the body portion 11 is in the form of an alternatively configured pair of shorts 300. FIGS. 13 and 14 show the shorts 300 in a first configuration with the free ends 19 of the two straps 16 connected to a pair of the attachment portions 18 arranged at opposed sides of a waist region 302 of the shorts 300. FIG. 15 shows the shorts 300 in a second configuration with the free ends 19 of the straps 16 separated from the attachment portions 18 to be suspended from the shorts 300. The second configuration is typically a result of the free ends 19 of the straps 16 being manually separated from the associated attachment portions 18 during play of the sport.

In other embodiments (not illustrated), the body portion 11 of the garment 10 is in the form of a belt securable about a player's waist. The belt is configured as an at least partially stretchable loop and/or having a releasable mechanism, such as a buckle or complementary hook and lop fasteners, secured at opposed ends of the belt to allow releasably securing the belt around the player's waist. It will be appreciated that the belt may be worn over a player's shirt and/or shorts.

In the illustrated embodiments 100, 200, 300, the free end 19 of each strap 16 is associated with a tag 12, 14, and each tag 12, 14 is configured to releasably attach to one of the attachment portions 18. Each tag 12, 14 is shaped to be manually graspable to allow separating the tag 12, 14 from the attachment portion 18 to cause the tag 12, 14 to be suspended from the garment 100, 200 by the strap 16. A pair of side tags 12 are attachable to the pair of attachment portions 18 arranged at opposed sides of the garment 100, 200, and a rear tag 14 is attachable to the further attachment portion 18 arranged at the rear of the garment 100, 200. In the third embodiment 300, an alternative rear tag 306 is provided which is releasably connectable to a rear attachment portion 304 such that the tag 306 can be completely disconnected from the shorts 300.

While the illustrated embodiments 100, 200, 300 include three straps 16 connectable to three respective attachment portions 18, it will be appreciated that the garment 10 is configurable to include less, or more, straps 16 and/or attachment portions 18, for example, to suit a particular sport or game.

Some embodiments of the garment 10 are configured such that the further (rear) attachment portion 18 and the associated strap 16 and tag 14 are absent, and the garment 100, 200 only includes the opposed side attachment portions 18 and side straps 16, and, in some embodiments, also the side tags 12. In some embodiments, such as shown in FIGS. 13 to 15, the garment 10 includes a pair of the straps 16 configured to releasably connect to a pair of the attachment portions 18 arranged at opposed sides of the body portion 11, the further (rear) attachment portion 304, and the rear tag 306 configured to directly attach to, and disconnect from, the further attachment portion 304 to allow entirely separating the tag 306 from the body portion 11. Such embodiments may be useful where demonstrating separation of the rear tag 306, such as by a player waving the tag above head height, indicates a particular change in state of play of the game.

In the illustrated embodiments 100, 200, 300, the free end 19 of each strap 16 is fixed to one of the tags 12, 14 and the tag 12, 14 carries an attachment mechanism, such as hook and loop fasteners (discussed in greater detail below), to allow attaching to the attachment portion 18. It will be appreciated that, in some embodiments, the free end 19 of each strap 16 is directly attachable to the attachment portion 18 and the tag 12, 14 is fixed at a location along the strap 16. Typically, the tag 12, 14 is associated with the free end 19 by being fixed at or near the free end 19. In some embodiments (not illustrated), the tag 12, 14 is fixed partway along the strap 16, such as at a mid-point. It will also be appreciated that, in some embodiments, the tags 12, 14 may be absent from the garment 100, 200 and only the straps 16 are present. In such embodiments, the straps 16 themselves are arranged to allow being manually grasped and pulled during play of the sport to cause separation of the free ends 19 from the attachment portions 18.

In the illustrated embodiments, the shirt 100 and shorts 200 each have three straps 16. Each strap 16 is connected between the respective garment 100, 200 and one of the tags 12, 14. Each strap 16 defines opposed ends 17, 19 and is fixed at one end 17 to the garment 100, 200 and fixed at the other end 19 to the associated tag 12, 14. In some embodiments, the fixed end 17 is releasably secured to the garment 100, 200. In such embodiments, the free end 19 is configured to be separable from the attachment portion 18 when a first force is applied, and the fixed end 17 is configured to be separable from the garment 100, 200 when a second force is applied, the second force being greater than the first force. This allows the entire strap 16 to be entirely removed from the garment 100, 200, for example, during play to inhibit a significant and potentially damaging force being exerted through the strap 16, or for cleaning.

In other embodiments (not illustrated), the shirt 100 or shorts 200 has a single strap connectable between a single attachment portion 18 or tag 12, 14, at least two attachment portions 18 or tags 12, 14, or to each attachment portion 18 or each tag 12, 14, and the garment 100, 200. Such embodiments may be configured for variations of the sport where only one or two tags 12, 14 are releasably attached to the garment 100, 200 by the strap and one or two other tags 12, 14 are completely separable.

Each strap 16 may be configured to be at least partially stretchable to allow elongation of the strap 16, such as to allow absorbing force when the free end 19 is separated from the attachment portion 18, for example, when the associated tag 12, 14 is manually grasped and pulled during play of the sport. In the illustrated embodiment, each strap 16 is formed from a resiliently deformable material, such as neoprene, to provide a limited degree of stretch. In other embodiments (not illustrated), each strap 16 includes a stretchable portion secured to a non-stretchable portion(s), such as a section formed from an elasticated fabric connected between substantially inextensible webbing sections. In some embodiments, at least a portion of at least one strap 16 is highly stretchable, such as allowing 100% or greater elastic recovery, so that the free end 19 of the strap 16, and the associated tag 12, 14, is readily positionable to be spaced from the body portion 11, such as being manually held above the wearer's shoulder or head height to indicate a change in state of play, and then retracted by the strap 16 returning to its original shape to be adjacent the body portion 11. In such embodiments, a substantial portion of the strap 16 is formed from the highly stretchable material such that when the free end 19 of the strap 16 is connected to the attachment portion 18, the strap 16 is contracts sufficiently that no, or very little, length of the strap 16 hangs below the attachment portion 18.

Best shown in FIGS. 5 to 8, 12 and 15, in the illustrated embodiments 100, 200, 300, the fixed end 17 of each strap 16 is connected to one of the attachment portions 18 of the shirt 100 or shorts 200, 300 and the free end 19 is fixed to one of the tags 12, 14 to allow releasably connecting the free end to the same attachment portion 18 via the tag 12, 14.

The attachment portions 18 are arranged so that, when the shirt 100 or shorts 200 is worn by a player, the attachment portions 18 are located adjacent the player's sacrum and each hip. The location of the attachment portions 18 in this way allows arranging the tags 12, 14, in the first configuration, at defined positions about the players waist. This can usefully present the tags 12, 14 to opponent players in a readily viewable and graspable position to allow playing the sport. In other embodiments (not illustrated), the attachment portions 18 are arranged at alternative locations on the garment 100, 200, such as a sleeve 104, chest covering portion 106, shoulder portion 108, or upper back portion 110 of the shirt 100, to allow placing the tags 12, 14 at the alternative locations.

Each attachment portion 18 is configured to releasably attach to the free end 19 of the strap 16 directly, or to the tags 12, 14 to allow indirect connection of the free end 19 of the strap 16 to the attachment portion 18. In the illustrated embodiments 100, 200, each attachment portion 18 is configured as a patch 20 fixed to the garment 100, 200 and including hook and loop fasteners, such as Velcro, configured to connect to complementary hook and loop fasteners carried by the tags 12, 14. It will be appreciated that, in some embodiments, the hook and loop fasteners may be carried by the free ends 19 of the straps 16. The fasteners are configured to form a weak connection such that the tag 12, 14 or the strap 16 can be easily manually separated from the associated attachment portion 18. In other embodiments (not illustrated), each attachment portion 18 includes a magnet fixed to the shirt 100 or shorts 200 to allow magnetically attracting a ferrous metallic portion fixed to the associated tag 12, 14 or strap 16 to releasably attach the tag 12, 14 or strap 16 to the garment 100, 200. It will be appreciated that this arrangement may be reversed such that the attachment portions 18 carry the metallic portion and the tags 12, 14 or straps 16 carry the magnets. In yet other embodiments (not illustrated), the attachment portions 18 and tags 12, 14 or straps 16 carry alternative releasable mechanical fasteners, such as snap fasteners (also known as press studs).

In the illustrated embodiments, each patch 20 is shaped to define a triangular profile. The patches 20 are shaped in this way to form a visual target which may enhance visibility of the patch 20 during play. It will be appreciated that, in some embodiments, only some of the patches 20 are shaped to be triangular. For example, the patch 20 arranged to attach to the rear tag 14 may be rectangular to define a large surface area to secure the tag 14 or strap 16 to. Also, in some embodiments each patch 20 is coloured a highly visible colour, such as fluorescent yellow, and/or a colour which starkly contrasts with the colour of the adjacent portion of the shirt 100 or shorts 200, such as a white patch 20 fixed to black fabric of the shirt 100 or shorts 200.

In the illustrated embodiments, each tag 12, 14 is configured as an elongate strip of fabric which is configured such that attaching the tag 12, 14 to the attachment portion 18 arranges an end portion 15 of the strip to be spaced from the attachment portion 18. This allows the end portion 15 to be manually grasped, such as when playing the sport. The free end 19 of the associated strap 16 is connected to one side of, and adjacent an end, of the tag 12, 14 such that the connected side of the tag 12, 14 is securable to the attachment portion 18. In some embodiments, the end portion 15 of the tag 12, 14 is weighted, such as by carrying metallic or plastic beads, to draw the end portion 15 downwards. This can enhance presentation of the tag 12, 14 for grasping during play. In other embodiments (not illustrated), the tags 12, 14 are alternatively configured to allow manual grasping, such as defining or carrying a pad, ball, loop, or handle. In some embodiments, each tag 12, 14 comprises a resiliently deformable tubular grip secured to the strap 16.

The straps 16 are dimensioned to allow the free end 19, and any associated tag 12, 14, to be separated and swing freely from the garment 100, 200. Typically, the straps 15 are dimensioned so that the free end 19 of the strap 16, and/or the tag 12, 14, is suspended below the bottom hem of the garment 100, 200. Configuring the straps 16 to define sufficient length to cause the free end 19 to swing freely from the garment 100, 200 can provide a highly visible indicator that the free end 19 of the strap 16 is separated from the attachment portion 18. This may indicate to players and/or the referee that a change of state of play must occur. In some embodiments, at least one of the straps 16 is brightly coloured to enhance indicating when the free end 19, and any associated tag 12, 14, has been separated from the attachment portion 18. In some embodiments, only one side of the strap 16, such as the side which is connected to the tag 12, 14, is brightly coloured and the strap 16 is configured so that this side is substantially covered, such as by the strap 16 being folded on itself, when the tag 12, 14 is attached to the attachment portion 18, and only revealed when the tag 12, 14 is separated from the attachment portion 18.

In some embodiments, the garment 100, 200, 300 carries an electronic device (not illustrated) configured to wirelessly communicate location data with a remotely located computing device or server, such as a laptop computer at the playing field, or a server hosted remotely and accessed via the Internet. For example, in some embodiments, the device allows communicating with the computing device/server to register when a player enters the field. In other embodiments, the device allows recording performance data, such as running distance, speed, and/or position, to allow real-time or post-match analysis using the computing device.

The garments 100, 200, 300 are configured to be worn by players of a sport, typically being a team sport, and most typically being a non-contact ball sport, such as rugby Union football, to allow playing the sport. The shirt 100 or shorts 200, 300 are initially worn by each player in the first configuration, with each tag 12, 14 attached to the respective attachment portion 18.

During play, a defending player can grasp and pull either or both of the side tags 12 of an attacking player's garment 100, 200, 300 to cause the grasped side tag(s) 12 to separate from the attachment portion(s) 18. This indicates to all players, and a referee, a change in the state of play. Where the garment 100, 200, 300 is worn to play a ball sport, this may have the effect of indicating the attacking player is tackled, meaning that the player must release the ball and/or play must cease. For example, when the garment 100, 200, 300 is used to play rugby football, releasing one of the side tags 12 may indicate that the attacking player must place the ball on the ground. This may also prompt the attacking team players to form a ruck at the location where the tag 12 was separated from the attachment portion 18.

After at least one of the side tags 12 is separated from the associated attachment portion 18, another player of the attacking team may grasp and pull the rear tag 14, 306 of the tackled player's garment 100, 200, 300. This indicates to all players, and a referee, a further change in the state of play, such as reinitiating play. For example, when the garment 100, 200, 300 is used to play rugby football, releasing the rear tag 14, 306 of the tackled player may mean that the attacking team must form a ruck and/or start play again at the ruck. In embodiments where the rear tag 14 is entirely separable from the body portion 11, such as the illustrated shorts 300, or the associated strap 16 is highly stretchable, this action may be followed by a player holding the rear tag 14 in a highly visible position, such as waving the tag 14 above shoulder or head height. This may be referred to as 'cleaning out' the ruck. This action may also mean that one or more players of the attacking team must adopt a position to defend the ruck, such as standing up-field of the ruck, towards the defending team's try line.

After at least one side tag 12, and then the rear tag 14, is separated from the attachment portions 18, the player wearing the garment 100, 200, 300 which has had tags 12, 14, 306 separated from attachment portions 18 may be required to reattach all of the tags 12, 14, 306 to the attachment portions 18 before re-joining play.

Typically, after seven 'tackles', being side tag 12 release events, this indicates the attacking team must relinquish possession of the ball to the defending team. Play may then recommence with the team's roles reversed.

It will be appreciated that playing the sport with embodiments of the garment 10 which do not include any tags is modified so that the straps 16 may be manually grasped and pulled to cause the free end 19 of at least one strap 16 to separate from the attachment portion 18. This may indicate a change of state of play of the sport as described above.

The illustrated embodiments of the garment 100, 200, 300 include a plurality of the tags 12, 14 which are secured thereto by the straps 16. This arrangement means that during play, when any of the tags 12, 14 are detached from the attachment portion 18, the tags 12, 14 remain physically connected to the garment 10 but visibly unattached and separated from the attachment portions 18. This means that players of the game can readily see that the tag 12, 14 has been removed from the attachment portion 18, indicating a change in state of play. This also means that the tags 12, 14 can be readily reattached to the garment 100. This can advantageously avoid players needing to locate a removed tag, which could involve walking/running a substantial distance to find the tag(s), and stooping to pick up the tag from the ground, both of which can delay game play, dissipate a player's energy, and be a cause of injury, particularly for older players. Furthermore, maintaining a physical connection between the tags 12, 14 and the garment 10 inhibits disrespectful conduct during play, such as a defending player throwing a removed tag across the field or running away with a removed tag. Such behaviour can frustrate or disadvantage the attacking team due to delaying the tackled player reattaching the removed tag to allow re-joining the game.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A garment for playing sport, the garment including:

a body portion configured to be worn on a user's body;

a pair of attachment portions arranged to be spaced from each other at opposed sides of the body portion; and a pair of elongate straps, each strap defining a fixed end secured to the body portion, an opposed free end, and an intermediate portion extending between the ends, wherein the free end of each strap is associated with a tag configured to releasably attach to one of the attachment portions, wherein each tag is shaped to be manually graspable to allow separating the tag from the attachment portion to suspend the tag from the garment by the strap, each tag including an elongate strip configured such that attaching the tag to one of the attachment portions arranges an end of the strip to be spaced from the attachment portion to allow the end to be grasped, wherein the attachment portions are positioned on the garment to arrange the pair of attachment portions and the tags, when attached to the attachment portions, adjacent the user's hips.

2. The garment according to claim 1, including a further attachment portion arranged at a rear of the body portion, and a rear tag configured to releasably attach to the further attachment portion, the rear tag shaped to be manually graspable to allow separating the rear tag from the further attachment portion such that the rear tag is disconnected from the body portion.

3. The garment according to claim 2, wherein the further attachment portion is positioned on the garment such that, when the garment is worn by the user, the further attachment portion is arranged adjacent the user's sacrum.

4. The garment according to claim 3, wherein the further attachment portion is configured as a triangular shaped patch.

5. The garment according to claim 1, wherein each strap is at least partially stretchable to allow elongating the strap when the free end is manually separated from the attachment portion.

6. The garment according to claim 1, wherein the free end of each strap is configured to be separable from the attachment portion when a first force is applied, and the fixed end of each strap is releasably secured to the garment and configured to be separable from the garment when a second force is applied, the second force being greater than the first force.

7. The garment according to claim 1, wherein each attachment portion and free end of each strap is associated with complementary hook and loop fasteners operable to releasably attach the free end to the attachment portion.

8. The garment according to claim 1, wherein each of the pair of attachment portions are configured as a triangular shaped patch.

9. The garment according to claim 1, wherein the body portion is configured as one of: a pair of shorts, a pair of leggings, a pair of tights, a belt, or a pair of pants.

10. The garment according to claim 1, including a further attachment portion arranged at a rear of the body portion, and a rear tag configured to attach to, and disconnect from, the further attachment portion such that the rear tag is separable from the body portion.

* * * * *